US007185739B1

(12) United States Patent
Blehm

(10) Patent No.: US 7,185,739 B1
(45) Date of Patent: Mar. 6, 2007

(54) PORTABLE TETHER ANCHOR / LADDER ROOF ANCHOR

(76) Inventor: Berle G. Blehm, 3120 Foothill Rd., Oroville, CA (US) 95966

( * ) Notice: Subject to any disclaimer, the term of this patent is extended or adjusted under 35 U.S.C. 154(b) by 0 days.

(21) Appl. No.: 11/225,308

(22) Filed: Sep. 12, 2005

(51) Int. Cl.
*E06C 7/06* (2006.01)
*E04C 7/42* (2006.01)

(52) U.S. Cl. ..... 182/214; 182/107

(58) Field of Classification Search ..... 182/214, 182/107, 121, 108, 206, 129, 45; 248/210, 248/238, 237, 211
See application file for complete search history.

(56) References Cited

U.S. PATENT DOCUMENTS 3,910,378 A * 10/1975 Nyman ..... 182/214
5,078,231 A * 1/1992 Davis ..... 182/107
5,890,560 A * 4/1999 Sloop ..... 182/107
6,550,577 B1 * 4/2003 Allgire ..... 182/107
6,595,324 B2 * 7/2003 Brown ..... 182/106
6,913,114 B1 * 7/2005 Blehm ..... 182/214
6,994,188 B2 * 2/2006 Hockensmith ..... 182/214

* cited by examiner

*Primary Examiner*—Hugh B. Thompson, II
(74) *Attorney, Agent, or Firm*—William W. Bodnar

(57) ABSTRACT

A portable tether anchor/ladder roof anchor assembly for attaching to and securing a ladder to the roof ridge of a building and providing a tether anchor for fall protection. One embodiment consists of an assembly attached to the rungs of a ladder to allow a ladder to be rolled up onto a roof, turned over and secured in position over the roof ridge to be used as a tether anchor and a ladder roof anchor.

10 Claims, 3 Drawing Sheets

PORTABLE TETHER ANCHOR / LADDER ROOF ANCHOR

CROSS REFERENCE TO RELATED APPLICATIONS

None.

BACKGROUND OF THE INVENTION

This present invention relates to ladder attachment devices, and more particularly to a new and improved device for providing a portable tether anchor and ladder roof anchor for use over the roof ridge of a building.

In the performance of their occupation, workers such as painters, carpenters, roofers, firepersons, chimney sweeps, inspectors, handypersons and others are required, at times, to perform their work on inclined roofs. Property owners also choose to work on their roofs at times. To work on moderate to highly pitched roofs, it is necessary for the person to position some type of support, such as a ladder, or scaffold, on the roof.

When the job is not too extensive, a section of a conventional extension ladder is often employed wherein the ladder is supported in an inclined position on the roof. The mere act of positioning the ladder on the roof may damage the roof in the process. Securing or anchoring the ladder to the roof also presents a problem.

It is also necessary in certain situations to have a tether anchor attached to a roof to provide a worker with a means of fall protection. In the past, operative access to roof areas during inspection and maintenance procedures on sloping roofs has been a major source of danger leading to falls from roofs and buildings. The traditional means of providing a tether anchor was to nail or screw a tether device into a roof. This method has a destructive component to it whether the roof receiving the tether device is in finished or unfinished condition. Obviously, a finished roof is subject to greater damage because the protective membrane (i.e. shingles, tile, etc.) will be breached and have to undergo repairs.

Prior art has attempted to address both the ladder anchor and tether anchor problems on different occasions. To overcome the ladder anchor problem, it has been proposed to provide ladders with hooks for engaging the ridge of the roof; such an arrangement is shown, for example, in U.S. Pat. Nos. 599,963; 2,755,981 and 3,606,226.

While these hook assemblies have been satisfactory for their intended purpose, they have been subject to certain disadvantages, such as being integrally connected to the ladder, thereby rendering the ladder cumbersome when using the ladder on other jobs not requiring the hook assembly; also, many of the hooks are not adjustable for properly engaging ridges of roofs of different pitches. These devices also tend to damage the roofs and thereby render such use prohibitive. None of these patents offers the features or advantages of the present invention.

U.S. Pat. No. 3,237,717 discloses an apparatus that is mounted on a roof to provide anchoring points for a roofer. A plurality of brackets are provided on the roof and are interconnected by rigid connecting rods. A flexible strap element is connected to the rigid rods in order to anchor a worker. The major shortcoming with this system is that it requires substantial rigging which would not be easily installed. Additionally, the extensive network of brackets and connecting rods obstruct the worker's movements and access to certain portions of the roof and can damage the roof.

A simple tether device which is adapted to be fastened to a peaked roof is disclosed in U.S. Pat. No. 4,249,713. A strip of metal is bent to provide a connector having a central portion and two extending leg portions. The extending leg portions are provided with openings through which a nail can be driven to attach the connector to the peak of the roof. A safety line is dipped to an aperture in the central portion of the connector. In order to allow the worker sufficient mobility on the roof, the safety line must be relatively lengthy, thereby increasing the distance a roofer would fall before he is caught, particularly when he is working near the connector. Also, since the safety line is at the roof level, it provides somewhat of a hazard in that a worker could easily trip over it. Further, it is an added obstruction to movement and subject to entanglement with roofing materials or tools on the roof surface.

No known prior art combines a ladder anchor and tether anchor in the same device that can be attached to a roof with causing damage to the roof. The closest known art is U.S. Pat. No. 6,913,114 issued to the present inventor/applicant.

SUMMARY OF INVENTION

The present invention is a portable tether anchor/ladder roof anchor for attaching to a ladder and securing a ladder over the roof ridge of the building while also providing a tether anchor for safety. It overcomes the deficiencies of the prior art by providing a portable device that, with proper use, will not have a destructive effect on the structure of a roof. It also provides the dual benefit of a ladder anchor and tether anchor in the same portable device.

In addition, a preferred embodiment of the present invention allows the roof anchor assembly to fold up between the rails of a ladder and set entirely within the silhouette/profile of the ladder between the ladder rails when not in use. This allows conventional use of the ladder even with the roof anchor assembly attached.

It is an object of the present invention to provide a ladder attachment assembly which will allow safe direct roof access.

It is also an object of the present invention to allow a user to position a ladder on a roof and anchor the ladder in place without damaging the roof in the process.

A further object of the invention is to allow a user to secure a tether device safely on a roof without damaging the roof by positioning the ladder attachment assembly over the roof ridge.

A further object of the invention is to allow normal use of a ladder without removing the tether anchor/ladder roof anchor assembly. The ladder can then be used for non-roof applications without removing the roof tether/anchor assembly from the ladder.

Additional advantages and novel features of the present invention will be set forth in part in the description which follows, and in part will become apparent to those skilled in the art upon examination of the following, or may be learned by practice of the invention. The advantages of the invention may be realized and attained by means of the instrumentalities and combinations particularly pointed out in the appended claims.

BRIEF DESCRIPTION OF DRAWINGS

The character of the invention, however, may be best understood by reference to one of its structural forms, as illustrated by the accompanying drawings, described below.

FIG. 5 shows another perspective view from the back side of the ladder showing attachment to the rungs.

DETAILED DESCRIPTION (OF A PREFERRED EMBODIMENT)

Figure 1:
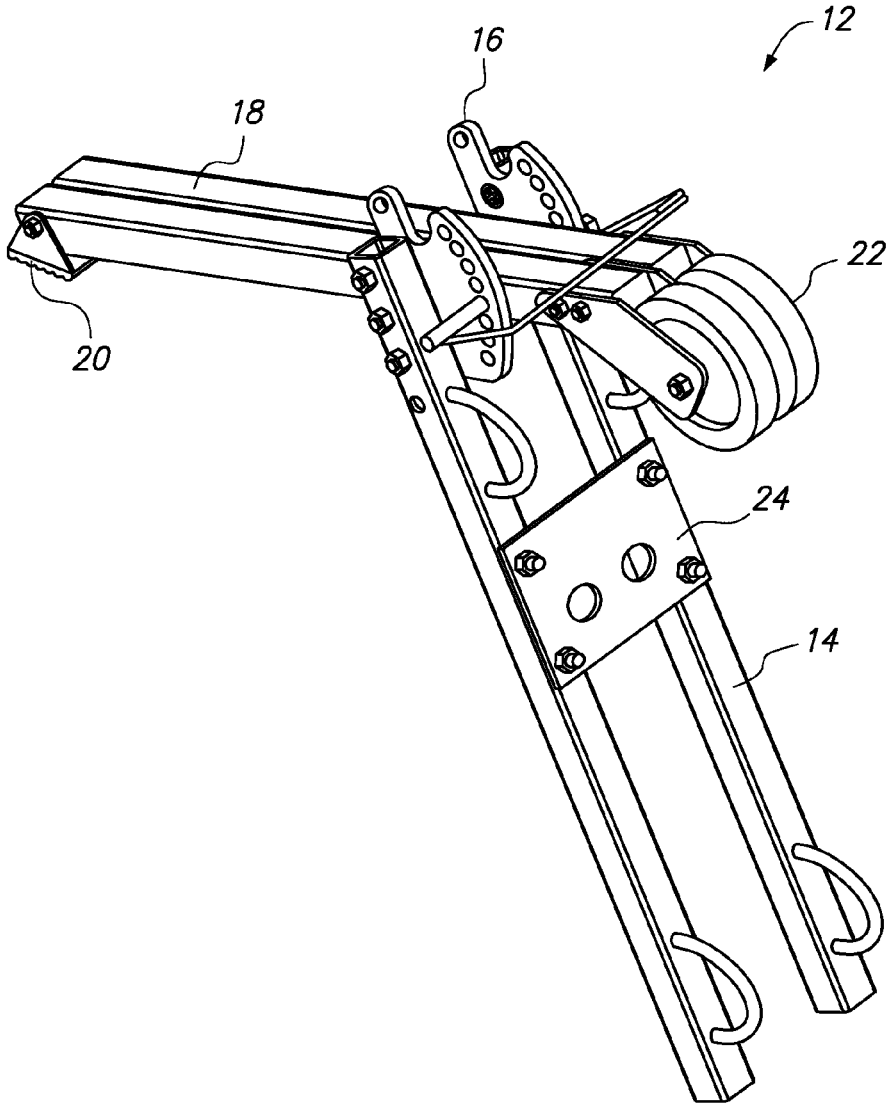
FIG. 1 is a perspective view of an embodiment of the portable tether anchor/ladder roof anchor.

Referring to FIG. 1, which best shows the general features of a preferred embodiment of the invention, the portable tether anchor/ladder roof anchor 12 is shown.

FIG. 1 shows a detailed view of the various components comprising the portable tether anchor/ladder roof anchor 12. Two support legs 14 are positioned against the outer surfaces of two index plates 16. Two mount legs are positioned between the two index plates 16 and support legs 14 as shown. Attaching means affix the mount legs 18 to the index plates 16 and support legs 14 such that the mount legs 18 can pivot to create an angle between the mount legs 18 and support legs 14 of from 0 degrees to 180 degrees. The index plates 16 have various positioning holes to allow indexing to the desired angle to match the slope of a particular roof line. A pin or securing mechanism is used to secure the mount legs 18 once the desired angle is achieved.

On opposite ends of the mount legs 18 are the base member 20 (a foot in this embodiment) and transport member 22 (a wheel is shown). A tether anchor 24 is shown secured to the support legs 14. The tether anchor depicted has one tether attachment opening through which to hook or fasten a tether line or rope. Other embodiments utilize more than one tether attachment opening on the tether anchor as well as secondary attachment openings to accommodate additional attachment needs.

Figure 2:
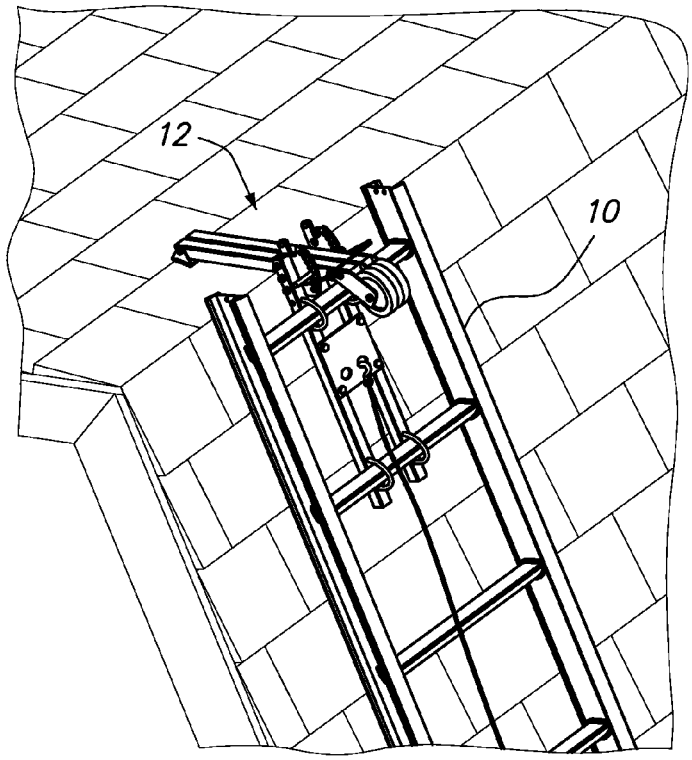
FIG. 2 is a perspective view of the portable tether anchor/ladder roof anchor attached to a ladder and securing a ladder to the roof of a building.

FIG. 2 shows the portable tether anchor/ladder roof anchor 12 attached to a ladder 10 and holding the ladder in place against the roof of a building. This view shows the ladder and portable tether anchor/ladder roof anchor in place after being rolled up onto the roof (see FIG. 3) and turned over.

Figure 3:
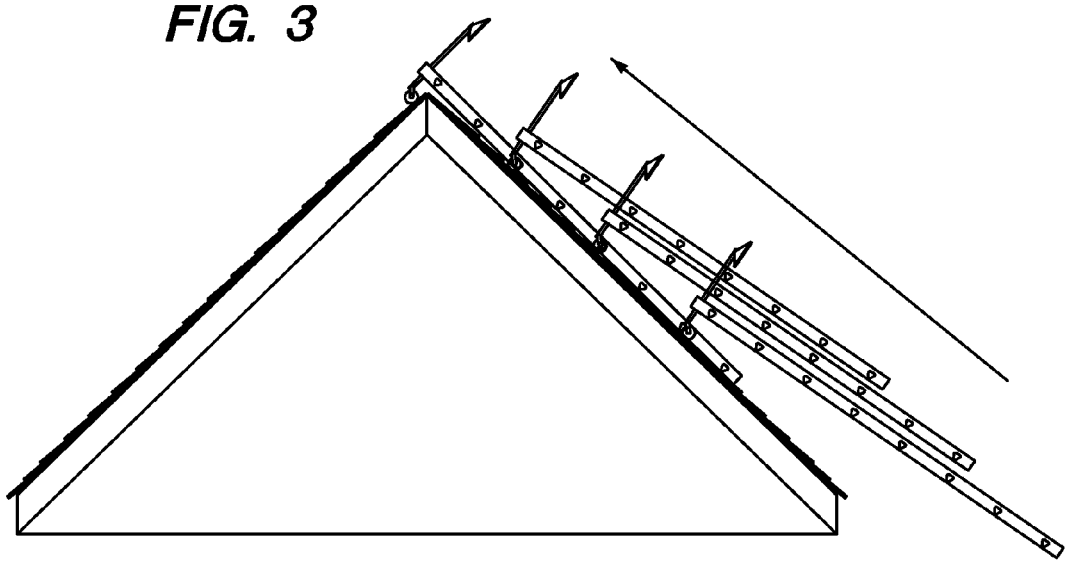
FIG. 3 is a side elevation view of a portable tehter anchor/ladder roof anchor and ladder in various positions as the ladder is being rolled up onto a roof.

FIG. 3 illustrates a method of using the device and shows various stages of a ladder and portable tether anchor/ladder roof anchor being rolled up onto a roof. In this embodiment, the wheels of the roof ridge anchor assembly allow the ladder to be placed in position over the roof ridge without damaging the roof. From the final position with the portable tether anchor/ladder roof anchor extending over the roof ridge as shown, the ladder can be turned or flipped over so that the feet are engaged against the roof as illustrated in FIG. 2. A tether line could be attached to the portable tether anchor/ladder roof anchor before the ladder is positioned onto the roof but is not shown in FIG. 3 for clarity of ladder positions.

Figure 4:
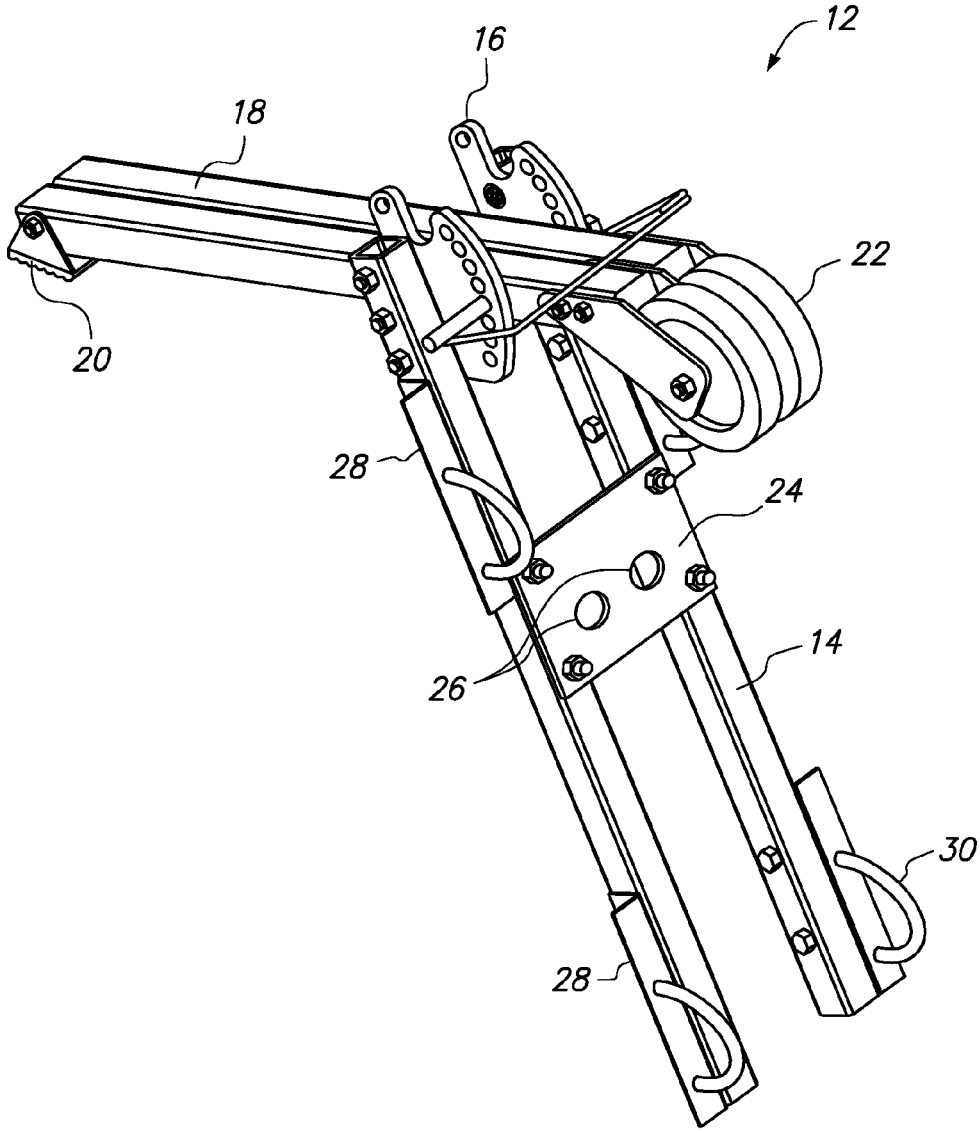
FIG. 4 shows a perspective view of the portable tether anchor/ladder roof anchor utilizing another means for attachment to the rungs of a ladder. The tether anchor in FIG. 4 also has multiple openings.

FIG. 4 shows a detailed view of the portable tether anchor/ladder roof anchor 12 utilizing another means for attachment to the rungs of a ladder. In this embodiment u-bolts 30 are supported by angle iron 28 attached to the support legs 14. The portable tether anchor/ladder roof anchor is attached to the rungs of the ladder via the u-bolts. The tether anchor 24 depicted in FIG. 4 has multiple tether attachment openings 26 through which to hook or fasten a tether line or rope.

FIG. 5 shows the bottom portion of a portable tether anchor/ladder roof anchor attached to the rungs of a ladder. This view illustrates how the angle iron 28 is attached to the support leg and shows the u-bolts 30 attached to the rung of a ladder.

CONCLUSIONS, OTHER EMBODIMENTS, AND SCOPE OF INVENTION

As described above and shown in the accompanying drawings, the portable tether anchor/ladder roof anchor offers a unique device that provides both a ladder anchor and tether anchor. This device provides the user with a roof anchor option that, when used properly, will not cause destruction of the roof. This device could also easily be used as a ladder stand-off against the roof or side of a building.

Another embodiment of this invention would use a pair of portable tether anchor/ladder roof anchor devices mounted on one ladder. In this configuration, there would be two base members and two transport members. Here a single tether anchor plate could be affixed to at least one support leg of each device so the pair of anchor devices would be affixed to each other independent of attachment means on the rungs of a ladder.

Yet another embodiment but not shown in these figures would include a single device with a wheel at one end of the mount leg and a horizontal bar attached to the opposite end of the mount leg. The horizontal bar would have a foot attached to each of its two ends. This would allow two feet to contact the roof for better anchoring while maintaining only one device, rather than the two devices shown and described in the preferred embodiment. A bar member could also be utilized when a pair of roof anchor devices are use together.

Typical base members could include any type of ladder feet or gripping surface that would allow contact with the roof and prevent slippage. In some cases, a non-stick surface or pad could be applied to a base member.

Transport members could include any type of wheel, castor or ball bearing mechanism that could allow the device to be rolled up the roof. For use on snow or ice-covered roofs, a transport member could have a smooth surface to allow the device to slide up the roof on top of the snow or ice.

The tether attachment opening in the tether anchor plate could be used to attach a tether line to provide fall protection when hooked to a harness worn by a person. Other openings in the tether anchor plate could be used to hook devices for secondary purposes, such as securing tools or equipment to the ladder. Conceivably a ground or vehicle-mounted power source could be utilized to provide an automated means of transporting tools, equipment or supplies up the ladder via the rails for example. The tether anchor plate would be used to facilitate this method of transport.

The portable tether anchor/ladder roof anchor could also be used against a roof or the side of a building as a ladder standoff device. This could be useful in preventing ladders from damaging gutters or windows for example. The base member with a bar and two feet on each end as described previously would be well suited for this purpose.

I claim:

1. A portable, non-destructive roof anchor and tether device for a ladder comprising:

a ladder roof anchor and a tether anchor connected to said ladder roof anchor;

said ladder roof anchor further comprising:

two support legs, two index plates connected to said support legs, and at least one mount leg rotatably affixed to said support legs and said two index plates;

said tether anchor further comprising:

a tether anchor plate affixed to said support legs wherein said tether anchor plate contains at least two tether attachment apertures.

2. The roof anchor and tether device of claim 1, wherein said at least one mount leg:

a base member at one end of said each mount leg; and a transport member at the opposite end of said each mount leg.

3. The anchor and tether device of claim 2 further comprising a transport locking mechanism to prevent each said mount leg transport member from moving.

4. The roof anchor and tether device of claim 2 wherein each said base member further comprises a non-slip surface.

5. The roof anchor and tether device of claim 2 wherein said base member comprises a bar; said bar having on each end a base member.

6. The roof anchor and tether device of claim 1, wherein:

each of said two support legs further comprises a plurality of apertures for attachment to the rungs of a ladder;

each of said index plates further comprises a plurality of positioning apertures, and each said index plate is affixed adjacent to and parallel to the upper end of one of said support legs; said index plates affixed parallel and opposite each other separated by a predetermined distance;

each of said at least one mount leg is rotatably affixed between said index plates; and said tether anchor plate is secured to each of said support legs.

7. The roof anchor and tether device of claim 6, further comprising:

at least one first fastener to secure each said index plate to the upper end of the corresponding adjacent support leg in a fixed position;

at least one second fastener to secure each said mount leg between said two index plates and said two adjacent support legs, such that each said mount leg is pivotally positioned between said index plates and support legs and able to rotate in a plane parallel to said support legs;

at least one locking mechanism to affix each said mount leg to said index plates such that each said mount leg is at a predetermined angle to said support legs;

at least one third fastener to secure said tether anchor plate to each said support leg such that said support legs are parallel to each other; and at least one fourth fastener to affix the support legs to the rungs of a ladder.

8. The anchor and tether device of claim 1 wherein said index plates have a plurality of positioning holes such that the angle between said mount leg and said two support legs is between 0 degrees and 180 degrees.

9. The roof anchor and tether device of claim 1 further comprising at least two mount legs, each mount leg comprising:

a base member at one end of said each mount leg; and a transport member at the opposite end of said each mount leg.

10. A method of using a roof anchor and tether device of comprising the steps of:

affixing at least one said roof anchor and tether device to a ladder;

adjusting all roof anchor and tether device mount legs to approximately match the slope or pitch of an applicable roof and locking the mount legs in position;

positioning the ladder and roof anchor and tether device on a roof;

transporting the ladder and roof anchor and tether device up the roof each mount leg is approximately over a ridge or peak of the applicable roof;

turning or flipping the ladder over until a base member of each mount leg contacts the roof;

climbing up the ladder attaching a tether line to an aperture on a tether anchor plate of said roof anchor and tether device; and attaching a secondary attachment line to another aperture on said tether anchor plate.

* * * * *